US007955686B2

(12) United States Patent
Halahmi et al.

(10) Patent No.: US 7,955,686 B2
(45) **Date of Patent: *Jun. 7, 2011**

(54) UV RESISTANT MULTILAYERED CELLULAR CONFINEMENT SYSTEM

(75) Inventors: Izhar Halahmi, Hod Hasharon (IL); Oded Erez, Tel Aviv (IL); Adi Erez, Tel Aviv (IL)

(73) Assignee: PRS Mediterranean Ltd., Tel Aviv (IL)

( * ) Notice: Subject to any disclaimer, the term of this patent is extended or adjusted under 35 U.S.C. 154(b) by 0 days.

This patent is subject to a terminal disclaimer.

(21) Appl. No.: 12/687,309

(22) Filed: Jan. 14, 2010

(65) Prior Publication Data

US 2010/0104800 A1 Apr. 29, 2010

Related U.S. Application Data

(63) Continuation of application No. 11/680,961, filed on Mar. 1, 2007, now Pat. No. 7,648,754.

(51) Int. Cl.

| | |
|---|---|
| ***B32B 1/00*** | (2006.01) |
| ***B32B 3/12*** | (2006.01) |
| ***E03B 7/14*** | (2006.01) |
| ***E03B 7/08*** | (2006.01) |
| ***E03B 7/02*** | (2006.01) |
| ***C08F 8/00*** | (2006.01) |
| ***C08L 23/00*** | (2006.01) |
| ***C08L 23/04*** | (2006.01) |

(52) U.S. Cl. ..... 428/141; 428/178; 428/116; 428/117; 428/118; 405/111; 405/114; 405/116; 405/117

(58) Field of Classification Search ..... 428/141, 428/178, 116, 117, 118, 105, 111, 114, 500, 428/516; 405/15, 16, 18, 19, 258.1, 111, 405/114, 115, 116, 117, 107, 109, 302.4; 524/500–538; 47/85; 525/217, 222, 232, 525/240; 52/664, 665, 668

See application file for complete search history.

(56) References Cited

U.S. PATENT DOCUMENTS

| | | | | |
|---|---|---|---|---|
| 6,817,806 | B1 * | 11/2004 | Arellanes | 405/114 |
| 6,855,650 | B1 | 2/2005 | Bohannon, Jr. | |
| 6,872,460 | B2 | 3/2005 | Murschall et al. | |
| 6,953,828 | B2 | 10/2005 | Dharmarajan et al. | |
| 7,648,754 | B2 * | 1/2010 | Halahmi et al. | 428/141 |
| 2002/0119011 | A1 | 8/2002 | Arellanes | |
| 2002/0192036 | A1 | 12/2002 | Marsteller et al. | |
| 2004/0129339 | A1 | 7/2004 | Arellanes | |

FOREIGN PATENT DOCUMENTS

| | | |
|---|---|---|
| CA | 1295137 | 3/1988 |
| EP | 0611849 | 8/1994 |
| WO | WO 2005060705 | 7/2005 |

* cited by examiner

*Primary Examiner* — Jennifer C McNeil
*Assistant Examiner* — Catherine Simone
(74) *Attorney, Agent, or Firm* — Richard M. Klein; Fay Sharpe LLP

(57) ABSTRACT

The present disclosure generally relates to a polymeric cellular confinement system which can be filled with soil, concrete, aggregate, earth materials, and the like. More specifically, the present disclosure concerns a cellular confinement system characterized by improved durability against damage generated by UV light, humidity, and aggressive soils, or combinations thereof.

26 Claims, 5 Drawing Sheets

UV RESISTANT MULTILAYERED CELLULAR CONFINEMENT SYSTEM

CROSS-REFERENCE TO RELATED APPLICATIONS

This application is a continuation of U.S. patent application Ser. No. 11/680,961, filed Mar. 1, 2007, now U.S. Pat. No. 7,648,754. This application is related to U.S. patent application Ser. No. 11/680,979, filed Mar. 1, 2007, now U.S. Pat. No. 7,541,084; and to U.S. patent application Ser. No. 11/680,987, filed Mar. 1, 2007, now U.S. Pat. No. 7,501,174; to U.S. patent application Ser. No. 11/680,996, filed Mar. 1, 2007, now U.S. Pat. No. 7,462,254; and to U.S. patent application Ser. No. 12/040,488, filed Feb. 29, 2008, which claimed priority to U.S. Provisional Patent Application Ser. No. 60/892,412, filed Mar. 1, 2007. All of these patent applications are hereby incorporated by reference in their entirety.

BACKGROUND

The present disclosure generally relates to a polymeric cellular confinement system which can be filled with soil, concrete, aggregate, earth materials, and the like. More specifically, the present disclosure concerns a cellular confinement system characterized by improved durability against damage generated by ultraviolet light, humidity, aggressive soils, and combinations thereof.

Plastic soil reinforcing articles, especially cellular confinement systems (CCSs), are used to increase the load bearing capacity, stability and erosion resistance of geotechnical materials such as soil, rock, sand, stone, peat, clay, concrete, aggregate and earth materials which are supported by said CCSs.

CCSs comprise a plurality of high density polyethylene (HDPE) strips in a characteristic honeycomb-like three-dimensional structure. The strips are welded to each other at discrete locations to achieve this structure. Geotechnical materials can be reinforced and stabilized within or by CCSs. The geotechnical material that is stabilized and reinforced by the said CCS is referred to hereinafter as geotechnical reinforced material (GRM). The surfaces of the CCS may be embossed to increase friction with the GRM and decrease relative movement between the CCS and the GRM.

The CCS strengthens the GRM by increasing its shear strength and stiffness as a result of the hoop strength of the cell walls, the passive resistance of adjacent cells, and friction between the CCS and GRM. Under load, the CCS generates powerful lateral confinement forces and soil-cell wall friction. These mechanisms create a bridging structure with high flexural strength and stiffness. The bridging action improves the long-term load-deformation performance of common granular fill materials and allows dramatic reductions of up to 50% in the thickness and weight of structural support elements. CCSs may be used in load support applications such as road base stabilization, intermodal yards, under railroad tracks to stabilize track ballast, retaining walls, to protect GRM or vegetation, and on slopes and channels.

The term "HDPE" refers hereinafter to a polyethylene characterized by density of greater than 0.940 g/cm$^3$. The term medium density polyethylene (MDPE) refers to a polyethylene characterized by density of greater than 0.925 g/cm$^3$ to 0.940 g/cm$^3$. The term linear low density polyethylene (LLDPE) refers to a polyethylene characterized by density of 0.91 to 0.925 g/cm$^3$.

The plastic walls of the CCSs may become damaged during service and use in the field by UV light, heat, and humidity (UHH). The damage results in brittleness, decreased flexibility, toughness, impact and puncture resistance, poor tear resistance, and discoloration. In particular, heat damage to the CCS is significant in hot areas on the globe. As used herein, the term "hot areas" refers to areas located 42 degrees latitude on either side of the equator and especially along the desert belt. Hot areas include, for example, North Africa, southern Spain, the Middle East, Arizona, Texas, Louisiana, Florida, Central America, Brazil, most of India, southern China, Australia, and part of Japan. Hot areas regularly experience temperatures above 35° C. and intensive sunlight for periods of up to 14 hours each day. Dark surfaces of plastics exposed to direct sunlight can reach temperatures as high as +90° C.

Some strategies have been applied industrially in order to protect the plastic walls from this damage by treating the polymer making up the plastic walls. For dark colored products, e.g., black or dark gray products, carbon black can be introduced to block UV light and dissipate free radicals. However, one disadvantage produced through the use of carbon black is its aesthetic appearance. Black CCSs are less attractive in applications where the CCS is part of a landscape structure. A second disadvantage is that black CCSs tend to absorb sunlight and heat up. HDPE and MDPE tend to creep when heated above 40-50° C. As a consequence, creep can be severely accelerated, especially in the welding points and thinner wall structures, potentially resulting in structural failures.

CCSs are usually immobilized or anchored to the GRM by wedges, tendons, bars, or anchors. This immobilization is especially crucial when the CCS is used to reinforce a slope. The wedges, tendons, bars, or anchors are usually made of iron, and can be heated by direct sunlight to temperatures that may exceed 60-85° C. The high conductivity of iron also transmits the heat to the buried portion of the CCS. These anchor points are subjected to severe stress concentrations. Without UHH protection, these anchor points may fail before any significant damage is observed in the rest of the CCS.

Stress is also generated at the welds between the strips making up the CCS. Stress can be applied from compression when humans walk over the CCS during installation, before and while it is filled with GRM, or when GRM is dumped onto the CCS to fill the cells. GRM can also expand when it becomes wet or when water already in the GRM freezes in cold weather. In addition, GRM has a coefficient of thermal expansion (CTE) about 5-10 times lower than the HDPE used to make the strips. Thus, the HDPE will expand much more than the GRM; this causes stress along the CCS walls and especially at the welds.

Some CCSs are pigmented to shades similar to the GRM they support. These include light colored products and custom-shaded CCSs, such as soil-like colored CCSs, grass-like colored CCSs and peat-like colored CCSs.

For CCSs, special additives (i.e. other than carbon black) are required in order to maintain their properties for periods of 20 years or more. The most effective additives are UV absorbers such as benzotriazoles and benzophenones, radical scavengers such as hindered amine light stabilizers (HALS), and antioxidants. Usually, "packages" of more than one additive are provided to the polymer. The additives are introduced into the polymer, usually as a master batch or holkobatch, a dispersion, and/or solution of the additives in a polymer carrier or a wax carrier.

The amount of additives in the polymer used to make the CCS depends on the life-time required for the CCS. To provide protection for periods of about 5 years, the amount of additives needed is less than if protection for a period of 10 years or more is required. Because additives leach out of the polymer, evaporate, or hydrolyze over time, the actual amount of additives required for protection over a long period of time is about 2 to 10 times greater than the amount that is needed for short term protection needs. In other words, the amount of additives added to the polymer must compensation for leaching, evaporation, and hydrolysis and is thus significantly greater than amount needed for short term protection. Moreover, as the heat and humidity where the CCS is to be used increases, more additives need to be added to the polymer to maintain its protection level.

The additives are generally dispersed or otherwise dissolved fairly evenly throughout the entire cross-section of the polymeric strips used to make the CCS. However, most interaction between the additives and the UHH damage-causing agents takes place in the outermost volume, i.e. 10 to 200 microns, of the polymeric strip or film.

Some hot areas, especially tropical areas, also experience high humidity and heavy rains. The combination of high humidity and heat accelerates the hydrolysis, extraction and evaporation of the protective additives from the polymeric strip. The most significant is the loss of UV absorbers, such as benzophenones and benzotriazoles, and heat stabilizers—especially hindered amine light stabilizers (HALS). Once such additives are lost, the polymeric strip is easily attacked and its properties deteriorate rapidly.

U.S. Pat. No. 6,953,828 discloses a membrane, including a geomembrane, stabilized against UV. The patent relates to polypropylene and very low density polyethylene compositions that are effective as membranes, but are not practical for CCSs. Polypropylene is too brittle at sub-zero temperatures. Very low density polyethylene is too weak for use in a CCS because it tends to creep under moderate loads. Once a CCS creeps, the integrity of the CCS and GRM is disrupted and structural performance is irreversibly damaged. In addition, polypropylene requires a large loading of additives to overcome leaching and hydrolysis; this results in an uneconomical polymer.

U.S. Pat. No. 6,872,460 teaches a bi-layer polyester film structure, wherein UV absorbers and stabilizers are introduced into one or two layers. Various grades of polyesters are generally applicable for geo-grids, which are two-dimensional articles used to reinforce soil, such as a matrix of reinforcing tendons. Geo-grids are usually buried underground and thus not exposed to UV light. In contrast, CCSs are three-dimensional and are usually partially exposed above ground level, thus exposed to UV light. Polyesters are generally unsuitable for CCSs due to their stiffness, poor impact and puncture resistance at ambient and especially at sub-zero temperatures, medium to poor hydrolytic resistance (especially when in direct contact with basic media such as concrete and calcined soils), and their overall cost. Again, polyesters require a large loading of additives to overcome leaching and hydrolysis; this results in an uneconomical polymer.

For thin polymeric strips (characterized by a thickness of less than about 500 microns), the actual amount of additive required generally matches the theoretical calculated required amount. In thicker strips (characterized by thickness of more than about 750 microns—that is usually the case with structural geotechnical reinforcing elements—CCS as example), however, the actual total amount of additive required is generally much higher than the theoretical calculated required amount. For high performance CCSs having thicknesses of about 1.5 mm or more, wherein strength, toughness, flexibility, tear, puncture resistance, and low temperature retention are required, the total amount of additive required is generally 5 to 10 times higher than the theoretical calculated required amount. UHH-protecting additives are very expensive relative to the cost of the polymer. Most manufacturers therefore provide the additives at loadings more closely matching the low (i.e. minimal) theoretical calculated loading level, not the higher loadings required for long-term protection for periods of 50 years and more. Moreover, HDPE and MDPE provide poor barrier properties against ingress of harmful ions and molecules into the polymer, and against leaching and evaporation of the additives from the polymer. Because of this, in reality, most manufacturers do not currently guarantee long-term durability of their thick polymeric strips. Current CCSs use HALS and UV absorbers in the amount of 0.1 to 0.25 weight percent dispersed throughout the polymeric strip.

Another aspect related to outdoor durability is the type of polymer used for the CCS. Selection of the correct polymer for this application is a tradeoff between economy, i.e. cost of raw materials, and long-term durability. In this regard, polyethylene (PE) is one of the most popular materials for use, due its balance of cost, strength, flexibility at temperatures as low as minus 60° C., and ease of processing in standard extrusion equipment. Moreover, polyethylene is moderately resistant against UV light and heat. However, without additives, polyethylene is susceptible to degradation within one year to a degree that is unacceptable for commercial use. Even when heavily stabilized, PE is still inferior relatively to more UV-resistant polymers, such as ethylene-acrylic ester copolymers and terpolymers.

On the other hand, polymers that exhibit higher UV and heat resistance, such as acrylic and methacrylic ester copolymers and terpolymers, and specifically ethylene-acrylic ester copolymers and terpolymers, are very suitable to commercial application from the standpoint of UHH resistance. However, their relatively high cost and relatively low modulus and strength characteristics limit their wide-scale use in CCS applications.

There is a need to provide a cost-effective UHH-resistant polymeric strip and CCSs comprising the same, especially GRM-like light colored strips and CCSs thereof. Such CCSs are resistant to harsh conditions, especially outdoor applications, at climates ranging from arid, tropic, and subtropic to arctic, and have a useful service life of 50 years and more.

BRIEF DESCRIPTION

The present disclosure is directed to a geotechnical article, especially a cellular confinement system (CCS), which exhibits high durability against UV light, heat, and humidity, for periods of at least 2 years. In specific embodiments, the CCS exhibits such durability for at least 10 years. In further specific embodiments, the CCS exhibits such durability for at least 20 years and up to 100 years. By durability is meant lack of chalking or cracking, and retention of original color, surface integrity, strength, modulus, elongation to break, puncture resistance, creep resistance, and weld strength.

In an exemplary embodiment, the CCS comprises a plurality of polymeric strips. Each polymeric strip comprises at least one inner polymeric layer and at least one outer polymeric layer. The at least one outer polymeric layer is more resistant to UV light, humidity, or heat (UHH), than the at least one inner polymeric layer. Each polymeric layer comprises at least one kind of polymer. The at least one outer polymeric layer further comprises a UV absorber or a hindered amine light stabilizer (HALS). The UV absorber blocks and prevents the harmful UV light from penetrating to the at least one inner polymeric layer. The HALS deactivates harmful radicals generated in the outer layer(s) from diffusion into the inner layer(s) of the polymeric strip.

In further embodiments, a polymeric layer comprises an additive selected from the group consisting of antioxidants, pigments, and dyes.

In other embodiments, at least one polymeric layer may comprise a filler. In specific embodiments, the filler has higher heat conductivity than the polymer of the polymeric layer.

In still further embodiments, at least one layer of the polymeric strip comprises a pigment or dye. Preferably, the layer has a color similar to the GRM being supported by the CCS. Preferably, the color is not black or dark grey.

The CCS can be used for reinforcing a GRM.

Other CCSs, and devices are also disclosed. Methods of making and using the polymeric strip and/or CCS are also provided. These and other embodiments are described in more detail below.

DESCRIPTION OF THE DRAWINGS

The following is a brief description of the drawings, which are presented for the purposes of illustrating the exemplary embodiments disclosed herein and not for the purposes of limiting the same.

DETAILED DESCRIPTION

The following detailed description is provided so as to enable a person of ordinary skill in the art to make and use the embodiments disclosed herein and sets forth the best modes contemplated of carrying out these embodiments. Various modifications, however, will remain apparent to those of ordinary skill in the art and should be considered as being within the scope of this disclosure.

A more complete understanding of the components, processes and apparatuses disclosed herein can be obtained by reference to the accompanying drawings. These figures are merely schematic representations based on convenience and the ease of demonstrating the present disclosure, and are, therefore, not intended to indicate relative size and dimensions of the devices or components thereof and/or to define or limit the scope of the exemplary embodiments.

The present disclosure relates to a cellular confinement system (CCS) comprising a plurality of polymeric strips and having high long-term durability for use in outdoor applications. Each strip comprises at least one outer polymeric layer and at least one inner polymeric layer. The outer polymeric layer is more UHH resistant than the inner polymeric layer. In particular, the outer polymeric layer is more resistant against UV light, humidity, or heat (UHH) than virgin HDPE. The term "virgin HDPE" refers to any HDPE received from a reactor before it is mixed with any UV absorber or HALS additive. It is noted that any polymer from a reactor generally already contains 200-1000 ppm antioxidant.

Figure 1:
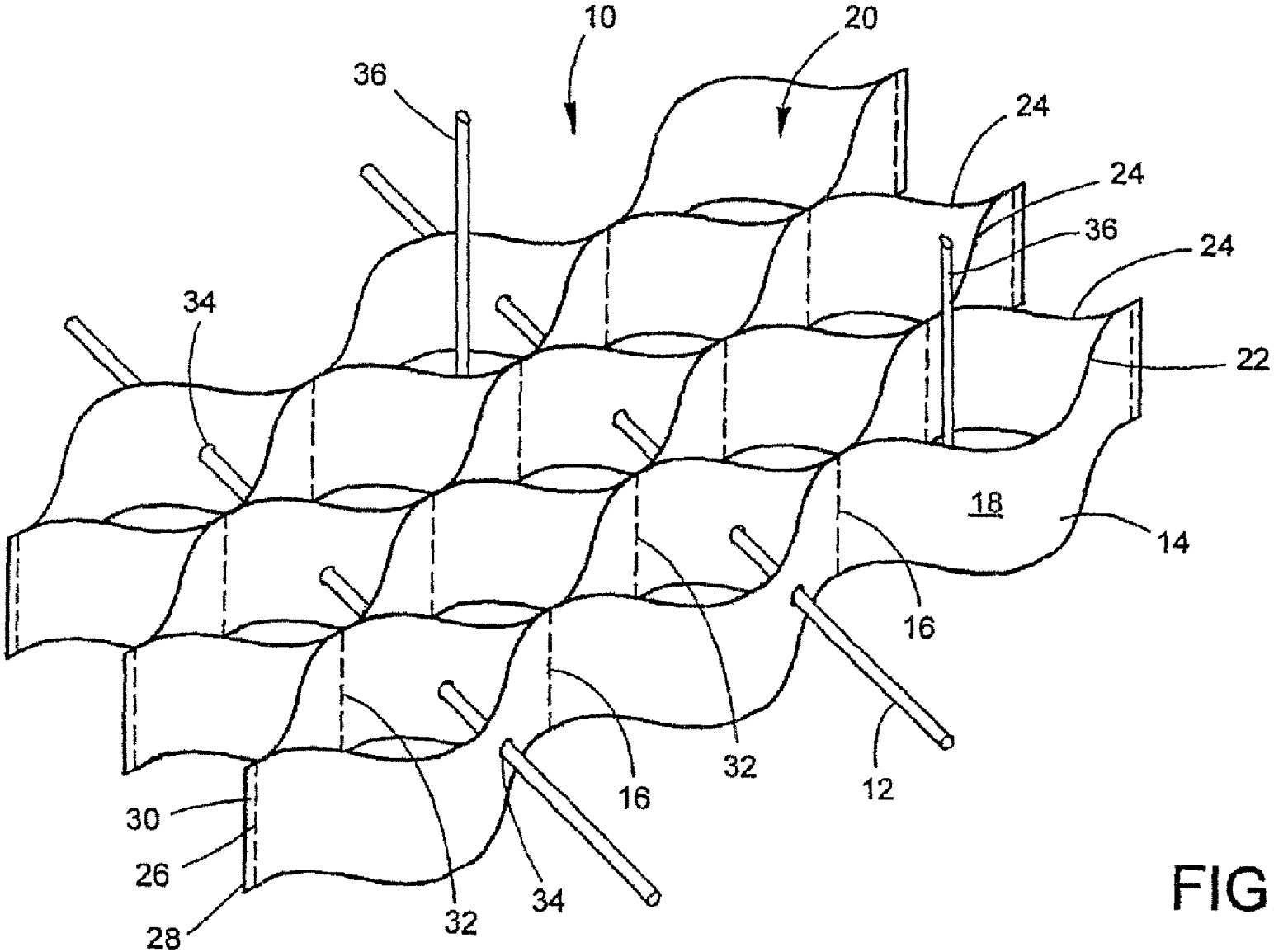
FIG. 1 is a perspective view of a single layer CCS.

FIG. 1 is a perspective view of a single layer CCS. The CCS 10 comprises a plurality of polymeric strips 14. Adjacent strips are bonded together by discrete physical joints 16. The bonding may be performing by bonding, sewing or welding, but is generally done by welding. The portion of each strip between two joints 16 forms a cell wall 18 of an individual cell 20. Each cell 20 has cell walls made from two different polymeric strips. The strips 14 are bonded together to form a honeycomb pattern from the plurality of strips. For example, outside strip 22 and inside strip 24 are bonded together by physical joints 16 which are regularly spaced along the length of strips 22 and 24. A pair of inside strips 24 is bonded together by physical joints 32. Each joint 32 is between two joints 16. As a result, when the plurality of strips 14 is stretched in a direction perpendicular to the faces of the strips, the strips bend in a sinusoidal manner to form the CCS 10. At the edge of the CCS where the ends of two polymeric strips 22, 24 meet, an end weld 26 (also considered a joint) is made a short distance from the end 28 to form a short tail 30 which stabilizes the two polymeric strips 22, 24.

The CCS 10 can be reinforced and immobilized relative to the ground in at least two different ways. Apertures 34 can be formed in the polymeric strips such that the apertures share a common axis. A tendon 12 can then be extended through the apertures 34. The tendon 12 reinforces the CCS 10 and improves its stability by acting as a continuous, integrated anchoring member that prevents unwanted displacement of the CCS 10. Tendons may be used in channel and slope applications to provide additional stability against gravitational and hydrodynamic forces and may be required when an underlayer or naturally hard soil/rock prevents the use of stakes. A wedge 36 can also be used to anchor the CCS 10 to the substrate to which it is applied, e.g., to the ground. The wedge 36 is inserted into the substrate to a depth sufficient to provide an anchor. The wedge 36 can have any shape known in the art (i.e., the term "wedge" refers to function, not to shape). The tendon 12 and wedge 36 as shown are simply a section of iron or steel rebar, cut to an appropriate length. They can also be formed of a polymeric material. They can be formed from the same composition as the CCS itself. It may also be useful if the tendon 12 and/or wedge 36 has greater rigidity than the CCS 10. A sufficient number of tendons 12 and/or wedges 36 are used to reinforce/stabilize the CCS 10. It is important to note that tendons and/or wedges should always be placed against the cell wall, not against a weld. Tendons and/or wedges have high loads concentrated in a small area and because welds are relatively weak points in the CCS, placing a tendon or wedge against a weld increases the likelihood that the weld will fail.

Additional apertures 34 may also be included in the polymeric strips, as described in U.S. Pat. No. 6,296,924. These additional apertures increase frictional interlock with the GRM by up to 30%, increase root lock-up with vegetated systems as roots grow between the cells 20, improve lateral drainage through the strips to give better performance in saturated soils, and promote a healthy soil environment. Reduced installation and long-term maintenance costs may also occur. In addition, such CCSs are lighter and easier to handle compared to CCSs with solid walls.

Figure 2:
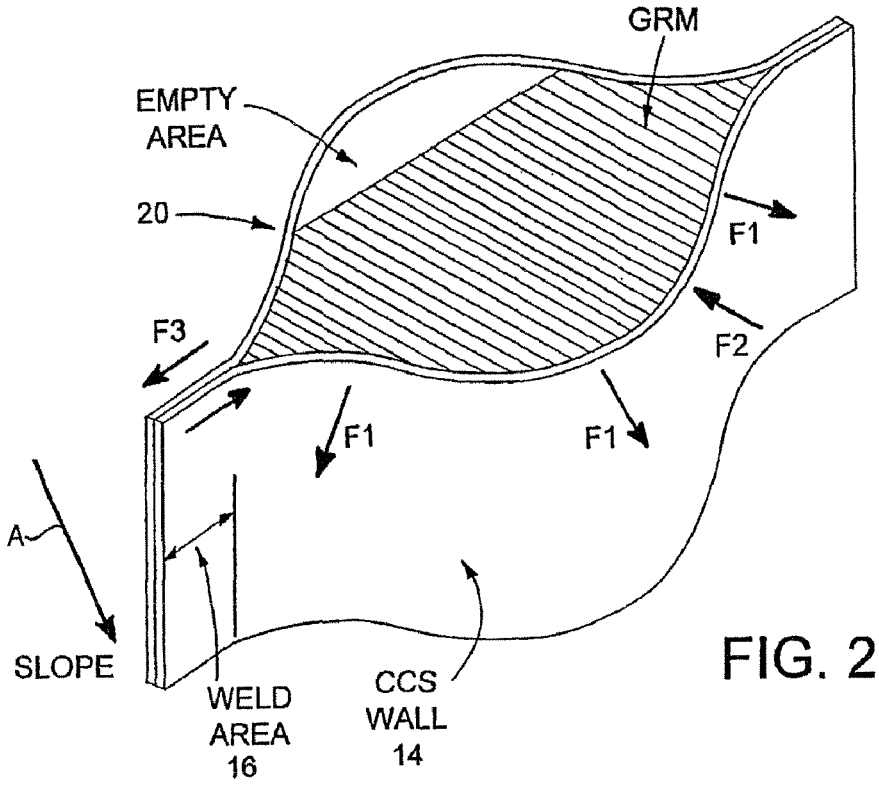
FIG. 2 is a perspective view of a cell containing a geotechnical reinforced material (GRM).

FIG. 2 is a perspective view of a single cell 20 containing a geotechnical reinforced material (GRM). The cell 20 is depicted as it might appear when the CCS is located on a slope (indicated by arrow A), so that the GRM retained within the cell 20 has settled substantially horizontally (i.e. flat relative to the earth's surface), while the cell walls 14 of the CCS 10 are substantially perpendicular to the slope A on which the CCS is located. Because the cell walls 14 are not aligned horizontally with the GRM, the GRM settles substantially on the down-slope cell wall and an "empty area" is left on the up-slope cell wall.

The cell walls 14 are subject to the forces F1 and F2. As a result of the tilting, force F1 (exerted by the weight of the GRM) and force F2 (exerted by the empty area of an adjacent down-slope cell) are not balanced. Force F1 is greater than force F2. This unbalanced force stresses the joints 16. In addition, the GRM exerts a separation force F3 against joints 16 as well. This separation force results from the mass of the GRM and natural forces. For example, the GRM will expand during humid periods as it retains water. The GRM will also expand and contract, e.g. from repeated freeze-thaw cycles of water retained within the cell 20. This shows the importance of a strong weld at each joint 16.

Figure 3:
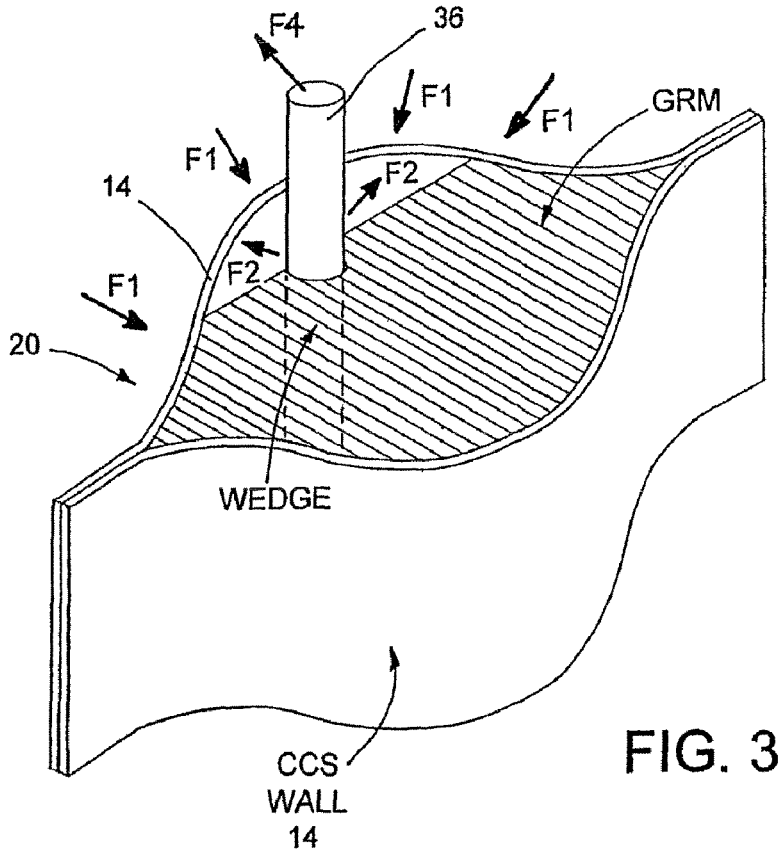
FIG. 3 is a perspective view of a cell containing a GRM and a wedge.

FIG. 3 is a perspective view of a single cell 20 containing a geotechnical reinforced material (GRM) and a wedge 36. The wedge 36 applies an additional force F4 on the up-slope cell wall to aid in balancing the forces on the cell walls 14. The additional force is applied on a localized part of the up-slope cell wall and can be detrimental to the cell wall if it is not sufficiently strong and creep-resistant.

Figure 4:
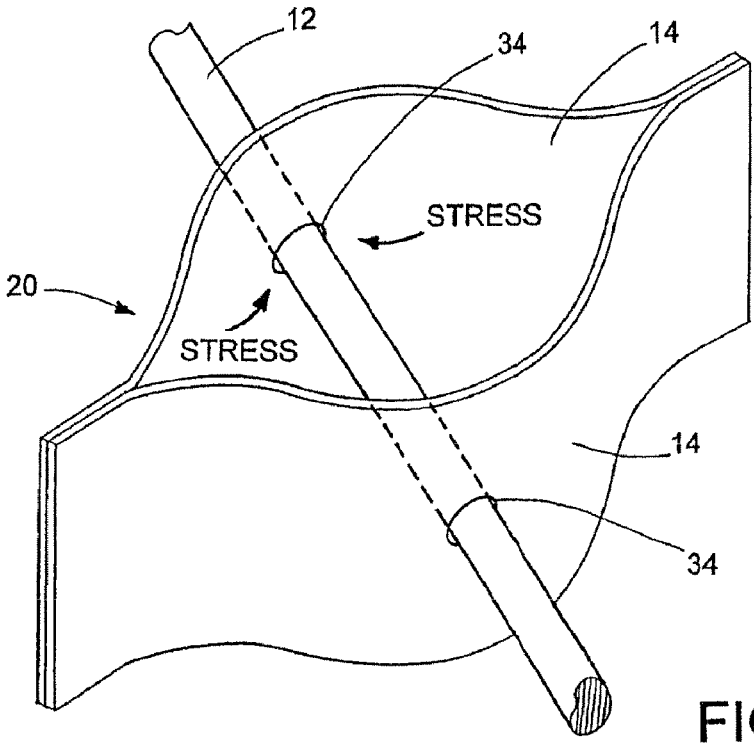
FIG. 4 is a perspective view of a cell containing a tendon.
Figure 5:
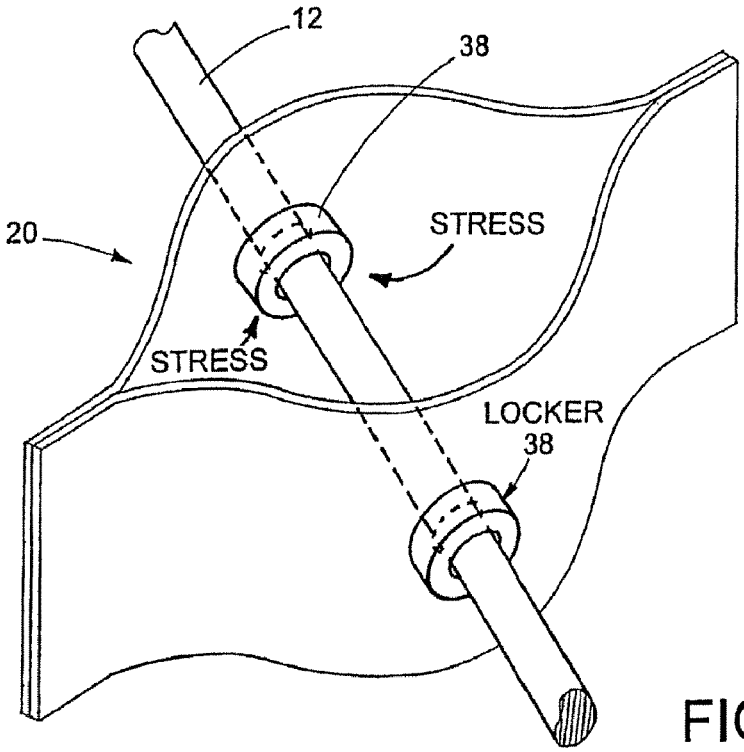
FIG. 5 is a perspective view of a cell containing a tendon and lockers.

FIGS. 4 and 5 are perspective views of a single cell 20 containing a tendon 12. As described above, the tendon 12 extends through apertures 34 in the strips 14 and is used to stabilize the CCS 10, especially in those situations where wedges 36 cannot be used. Stress is localized in the strips 14 around the apertures 34 as well. For example, the tendon 12 may have a different CTE from the strips 14. In applications where the strips 14 are provided with apertures 34 but no tendon 12 is used, GRM or water/ice can infiltrate the aperture 34 as well; expansion then increases stress and can damage the integrity of the strip 14. As shown in FIG. 5, lockers 38 can be used to spread the stress over a greater area, but the stress still exists. Use of a locker 38 provides added protection against failure in the long term.

Figure 6:
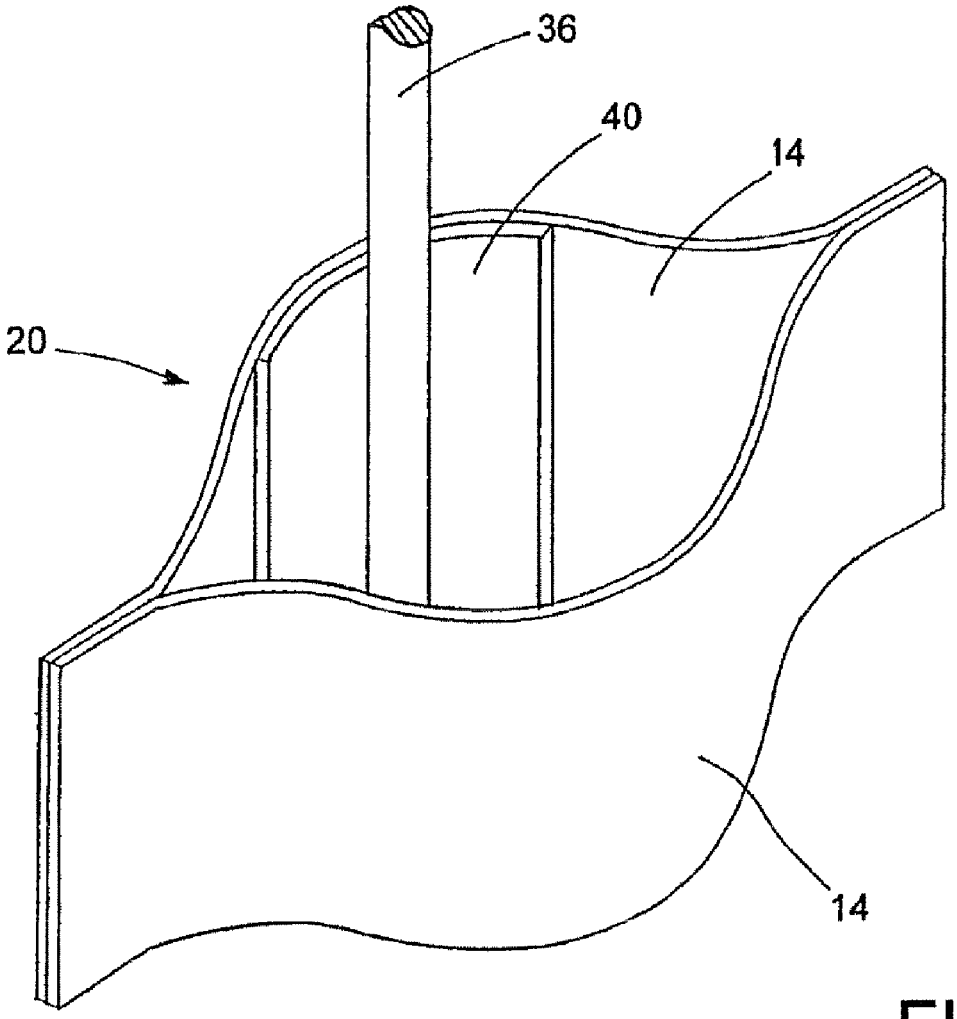
FIG. 6 is a perspective view of an exemplary embodiment of a cell including a reinforced wall portion.

FIG. 6 is a perspective view of an exemplary embodiment of a cell including a reinforced wall portion. A wedge 36 is located inside the cell 20. As discussed in reference to FIG. 3, the wedge 36 applies additional force on a localized part of the up-slope cell wall and can be detrimental to the cell wall if it is not sufficiently strong and creep-resistant. In an exemplary embodiment of the present disclosure, a reinforced wall portion 40 having a width greater than that of the wedge 36 is provided between the wedge 36 and the up-slope cell wall. Like the locker 38, the reinforced wall portion 40 spreads the stress over a greater area of the cell wall. In one embodiment, the reinforced wall portion 40 extends beyond the upper edge of the wall and is folded down over the far side of the wall, further increasing the strength of the overall wedge-contacting portion of the wall. In other embodiments, the reinforced wall portion 40 may also have an aperture 34 to accommodate the use of a tendon 12.

In one embodiment, the reinforced wall portion 40 is attached to the wall with an appropriate adhesive, e.g., a pressure-sensitive adhesive or a curable adhesive. In another embodiment, the reinforced wall portion 40 may be attached to the wall by a welding operation, particularly ultrasonic welding, or sewing, performed onsite. The reinforced wall portion 40 may be made from any suitable material. In particular embodiments, it is made from the same material as the cell wall. If desired, the reinforced wall portion 40 may also be more rigid than the wall to bear more of the stress itself.

Figure 7:
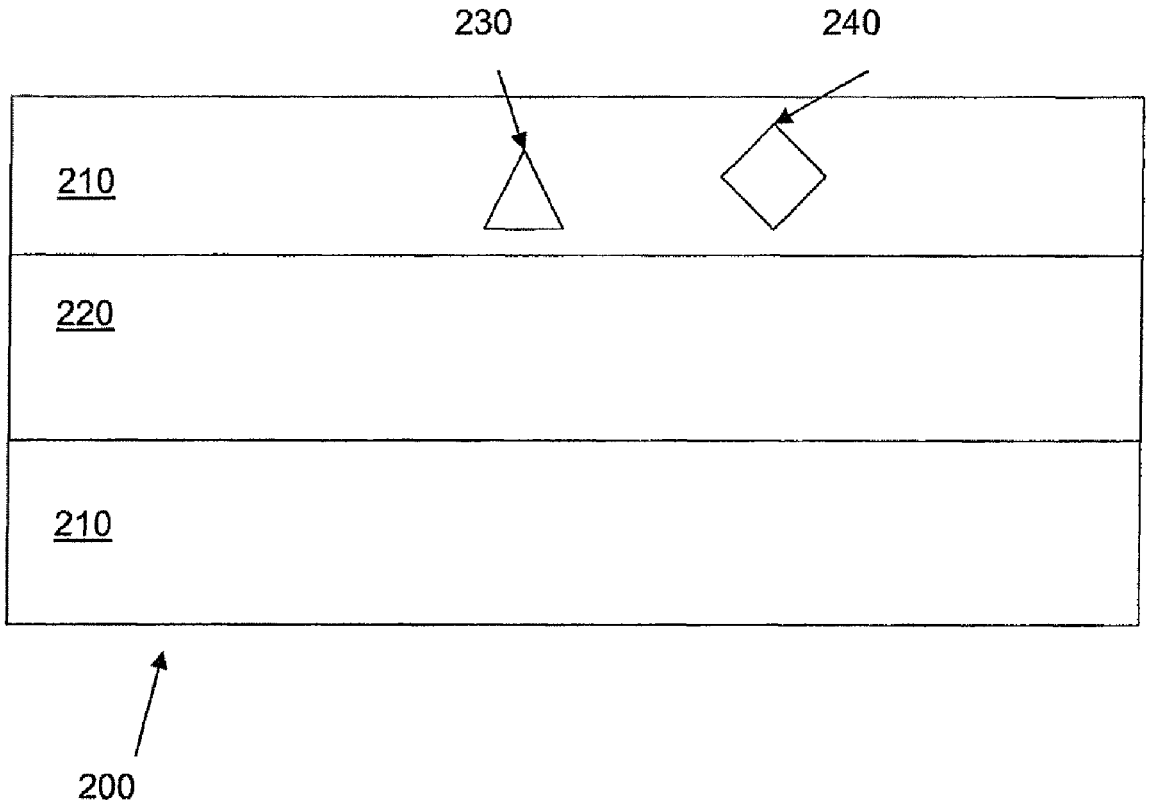
FIG. 7 is a view of an exemplary polymeric strip used in the CCS of the present disclosure.

FIG. 7 is a view of an exemplary polymeric strip used in the CCS of the present disclosure. The polymeric strip 200 comprises at least one outer polymeric layer 210 and at least one inner polymeric layer 220. Here, a polymeric strip having two outer polymeric layers 210 is shown. Dispersed within at least one outer polymeric layer 210 is a UV absorber 230 or a hindered amine light stabilizer 240.

The at least one outer polymeric layer of the polymeric strip comprises a UV absorber or a hindered amine light stabilizer (HALS). The UV absorber may be an organic UV absorber, such as a benzotriazole UV absorber or benzophenone UV absorber. The UV absorber may also be an inorganic UV absorber. The at least one outer polymeric layer may comprise further additives. The additive is selected from the group consisting of heat stabilizers, antioxidants, pigments, dyes, and carbon black.

The polymeric strip may comprise more than one outer polymeric layer. In a specific embodiment, the polymeric strip comprises a first outer polymeric layer and a second outer polymeric layer. The inner polymeric layer(s) lies between the first outer polymeric layer and the second outer polymeric layer. Each outer polymeric layer comprises a greater number of additives than the inner polymeric layer(s). In other embodiments, the polymeric strip comprises a first outer polymeric layer and a second outer polymeric layer. One outer polymeric layer comprises a greater total concentration of UV absorbers and HALS additives than the other outer polymeric layer.

In other embodiments, the polymeric strip is a single-layer strip.

The additive content in the outer polymeric layer(s) is sufficient to provide protection to the polymeric strip for a period of 2 to about 100 years. The term "about" refers hereinafter to a value 20% lower or higher than the given value modified by the term "about." In specific embodiments, the amount of additives provides sufficient protection to the polymeric strip for a period of at least 2 years. In further embodiments, the amount of additives provides sufficient protection to the polymeric strip for a period at least 5 years. In further specific embodiments, the amount of additives provides sufficient protection to the polymeric strip for at least 20 years and up to 50 years, regardless of weather conditions such as humidity, temperature, and UV light intensity. The term "sufficient protection" refers to the ability of the polymeric strip to retain both (i) its color and shade; and (ii) its mechanical characteristics for a period of 2 to 100 years within at least 50% of the polymeric strip's original color, shade color, or mechanical characteristics. Preferably, the polymeric strip retains at least 80% of its original color, shade color, or mechanical characteristics.

The outer polymeric layer(s) comprises a UV absorber. In particular embodiments, the UV absorber is organic and is a benzotriazole or a benzophenone commercially available as, for example, Tinuvin™, manufactured by Ciba, and Cyasorb™, manufactured by Cytec. The outer polymeric layer(s) may also comprise a hindered amine light stabilizer (HALS) alone or with the UV absorber. HALS are molecules which provide long term protection against free radicals and light-initiated degradation. In particular, HALS do not contain phenolic groups. Their limiting factor is the rate at which they leach out or are hydrolyzed. The organic UV absorber and HALS together are present in the amount of from about 0.01 to about 2.5 weight percent, based on the total weight of the layer.

The outer polymeric layer(s) may also comprise an inorganic UV absorber. In particular embodiments, the UV absorber has the form of solid particles. Solid particles are characterized by negligible solubility in polymer and water and negligible volatility, and thus do not tend to migrate out or be extracted from the layer(s). The particles may be microparticles, (e.g. from about 1 to about 50 micrometers in average diameter), sub-micron particles (e.g. from about 100 to about 1000 nanometers in average diameter), or nanoparticles (e.g. from about 5 to about 100 nanometers in average diameter). In specific embodiments, the UV absorber comprises inorganic UV-absorbing solid nanoparticles. Unlike organic UV absorbers that are soluble in polymer and have mobility even at high molecular weights, inorganic UV absorbers have practically no mobility and are therefore very resistant against leaching and/or evaporation. UV-absorbing solid nanoparticles are also transparent in the visible spectrum and are distributed very evenly. Therefore, they provide protection without any contribution to the color or shade of the polymer. Solid particles are also very insoluble in water, improving the durability of the polymer. In particular embodiments, the UV-absorbing nanoparticles comprise a material selected from the group consisting of titanium salts, titanium oxides, zinc oxides, zinc halides, and zinc salts. In particular embodiments, the UV-absorbing nanoparticles are titanium dioxide. Examples of commercially available UV-absorbing particles are SACHTLEBEN™ Hombitec RM 130F TN, by Sachtleben, ZANO™ zinc oxide by Umicore, NanoZ™ zinc oxide by Advanced Nanotechnology Limited and AdNano Zinc Oxide™ by Degussa. UV-absorbing particles may be present in a loading of from about 0.01 to about 85 weight percent, by weight of the polymeric layer. In more specific embodiments, inorganic UV-absorbing particles have a loading of from about 0.1 to about 50 weight percent, based on the total weight of the polymer layer. In a specific embodiment, the polymeric layer comprises an inorganic UV absorber, HALS, and an optional organic UV absorber.

In some specific embodiments, the inner polymeric layer(s) does not contain any organic UV absorbers, inorganic UV absorbers, or HALS additives. In other specific embodiments, the inner polymeric layer(s) may comprise organic UV absorbers and HALS together in an amount of from greater than 0 to about 0.5 weight percent, based on the total weight of the layer. The inner polymeric layer(s) may also comprise inorganic UV absorbers in an amount of from 0 to about 0.5 weight percent, based on the total weight of the layer.

Any layer may further comprise an antioxidant. Specific antioxidants which may be used include hindered phenols, phosphites, phosphates, and aromatic amines.

Any layer may further comprise a pigment or dye. Any suitable pigment or dye may be used which does not significantly adversely affect the desired properties of the overall polymeric strip. In specific embodiments, at least one layer of the polymeric strip (generally an outer polymeric layer) is colored so as to be about the color of the GRM supported by the polymeric strip. Generally, the color is other than black or dark gray, especially any color which is not in the gray scale. The colored polymeric layer need not be a uniform color; patterns of color (such as camouflage) are also contemplated. In specific embodiments, the polymer strip may have a vivid color, such as red, yellow, green, blue, or mixtures thereof, and mixtures thereof with white or black, as described by CIELAB color coordinates. A preferred group of colors and shades are brown (soil-like), yellow (sand-like), brown and gray (peat-like), off-white (aggregate like), light gray (concrete-like), green (grass-like), and a multi-color look which is stained, spotted, grained, dotted or marble-like. Such colors have the utilitarian feature of allowing the CCS to be used in applications where the CCS is visible (i.e. not buried or covered by fill material). For example, the CCS can be used in terraces where the outer layers are visible, but can be colored to blend in with the environment. In further particular embodiments, the polymeric strip contains a pigment or dye, but does not contain carbon black. Generally, for purposes of this application, carbon black is considered a UV absorber rather than a pigment.

A polymeric layer may further comprise a filler. The polymeric layer may comprise from about 1 to about 70 weight percent of filler, based on the total weight of the polymeric layer. In further embodiments, the polymeric layer comprises from about 10 to about 50 weight percent of filler or from about 20 to about 40 weight percent of filler, based on the total weight of the polymeric layer.

The filler may be in the form of fibers, particles, flakes, or whiskers. The filler may have an average particle size of less than about 50 microns. In further embodiments the filler has an average particle size of less than about 30 microns. In further embodiments, the filler has an average particle size of less than about 10 microns.

Several materials may serve as the filler. In some embodiments, the filler is selected from the group consisting of metal oxides, metal carbonates, metal sulfates, metal phosphates, metal silicates, metal borates, metal hydroxides, silica, silicates, aluminates, alumosilicates, fibers, whiskers, industrial ash, concrete powder or cement, and natural fibers such as kenaf, hemp, flax, ramie, sisal, newprint fibers, paper mill sludge, sawdust, wood flour, carbon, aramid, or mixtures thereof.

In further specific embodiments, the filler is a mineral selected from the group consisting of calcium carbonate, barium sulfate, dolomite, alumina trihydrate, talc, bentonite, kaolin, wollastonite, clay, and mixtures.

The filler may also be surface treated to enhance compatibility with the polymer used in the polymeric layer. In specific embodiments, the surface treatment comprises a sizing agent or coupling agent selected from the group consisting of fatty acids, esters, amides, and salts thereof, silicone containing polymer or oligomer, and organometallic compounds such as titanates, silanes, and zirconates.

In further specific embodiments, the filler has higher heat conductivity than the polymer of the polymeric layer. Generally, in polymer layers that have poor heat conductivity, the temperature of the polymer layer can increase significantly relative to the air nearby on a hot day from a combination of convection and direct sunlight absorption (i.e., the polymer layer will be more than 30° C. higher than the air temperature). If the polymer layer has high heat conductivity, its temperature will only slightly increase relative to the air nearby (i.e., by about 1 to 30° C. above air temperature). This increased temperature can accelerate degradation of the polymer due to Arrhenius-type acceleration kinetics and also accelerate the evaporation, hydrolysis, and/or leaching of the additives. Since most polymers, especially MDPE and HDPE, have poor thermal conductivity, heat accelerated degradation negatively impacts the lifetime of geotechnical articles, especially CCSs, using those polymers. Surprisingly, it has been found that when mineral filler is mixed with such polymers, the thermal conductivity and heat capacitance of the polymer increases. This significantly lowers the rate of heat accelerated degradation, resulting in extended lifetime and greater stability against UV-induced degradation. Improved heat conductivity also improves tendency to resist creep under combination of mechanical loads and UHH. Improved heat conductivity is especially important for geotechnical applications in areas where temperatures on the surface of the CCS exceed 70° C. and more. Typically, the hot areas on the globe located between 42 latitude north and 42 latitude south of the equator have such temperature extremes. It also reduces degradation, which generally has Arrhenius first order accelerating kinetics. In specific embodiments, a polymeric layer comprises a filler having high heat conductivity which is selected from the group consisting of metal carbonates, metal sulfates, metal oxides, metals, metal coated minerals and oxides, alumosilicates, and mineral fillers.

Adding mineral filler also lowers the CTE of the polymer. Whiskers and fibers are most effective in lowering CTE. The introduction of mineral fillers to the polymeric layer also improves the processing quality of the layer. The presence of filler in the melt lowers heat buildup by reducing torque during melt kneading, extruding and molding. This is especially important during melt kneading, which is a heat-generating process that can degrade the polymer. Surprisingly, when filler is introduced, less mechanical energy is required for melt kneading of a mass unit of compound relative to unfilled HDPE or MDPE, and thus the relative throughput per unit power increases and heat buildup in this compound along the extruder decreases. Moreover, resistance to shear during compounding and extrusion is lower than with HDPE. As a result, fewer gels are created and less degradation of the polymer occurs. This enables production of thinner strips under the same torque of the extruder and thus increased throughput rate, as measured by unit length per unit time.

In addition, it has been surprisingly found that when a polymeric layer comprises mineral filler and either a UV absorber or HALS, there is a synergistic effect such that the loss rate and the degradation rate of the UV absorber or HALS decrease. This is attributed to the lower heat buildup in the polymeric layer due to the improved heat conductivity imparted by the mineral filler.

A polymeric layer may further comprise barrier particles. Barrier particles are inorganic particles having high barrier properties. The term "barrier properties" refers to the ability of the inorganic particles to (1) reduce the rate of diffusion of additives from the polymeric layer into its surrounding environment; (2) reduce the rate of diffusion of hydrolyzing agents such as water, protons and hydroxyl ions from the surrounding environment into the polymeric layer; and/or (3) reduce the production/mobility of free radicals and/or ozone inside the polymeric layer. The major cause of loss of additives during the lifetime of the polymeric strip is due to diffusion, washing, hydrolysis, or evaporation. Such diffusion or degradation of additives depends, among other things, on their molecular weight, backbone structure, miscibility in the polymeric matrix, presence of ions, and temperature. Improving the barrier properties of the polymeric strip thus improves the durability of the polymeric strip. Preferably, the barrier particles are nanoparticles. In specific embodiments, the barrier particles are selected from the group consisting of clays, organo-modified clays, nanotubes, metallic flakes, ceramic flakes, metal coated ceramic flakes, and glass flakes. Preferably, the barrier particles are flakes which maximize surface area per unit mass. The polymeric layer comprising barrier particles is characterized by slower rate of leaching, evaporation and hydrolysis of said additives, relative to layers without the barrier particles. Barrier particles may be present in a loading of from about 0.01 to about 85 weight percent, by weight of the polymeric layer. In more specific embodiments, barrier particles have a loading of from about 0.1 to about 70 weight percent of the polymer layer. The permeability of the polymeric layer to molecules having a molecular weight lower than about 1000 Daltons should be at least 10 percent lower compared to a polymeric strip of the same composition but without the barrier particles. The permeability of the polymeric layer to molecules having a molecular weight lower than about 1000 Daltons should be at least 25 percent lower compared to a polymeric strip made from HDPE without the barrier particles.

As noted, each polymeric layer comprises a polymer. In specific embodiments, the polymer is selected from HDPE and medium density polyethylene (MDPE). In other embodiments, the polymer itself has improved UHH-resistant properties compared to virgin polyethylene. Such polymers are selected from the group consisting of (i) ethylene-acrylic acid ester copolymers and terpolymers; (ii) ethylene-methacrylic acid ester copolymers and terpolymers; (iii) acrylic acid ester copolymers and terpolymers; (iv) aliphatic polyesters; (v) aliphatic polyamides; (vi) aliphatic polyurethanes; mixtures thereof; and mixtures thereof with at least one polyolefin. Commercially available ethylene-acrylic ester copolymers and terpolymers include Elvaloy™ manufactured by Du-Pont or Lotryl™ manufactured by Arkema. In specific embodiments, each polymeric layer in a polymeric strip is made from the same polymer.

A polymeric layer may further comprise friction-enhancing integral structures. The increased friction decreases movement of the polymeric strip relative to the GRM it supports. These friction-enhancing structures are generally formed by embossing. The structures may comprise a pattern selected from the group consisting of textured patterns, embossed patterns, holes, finger-like extensions, hair-like extensions, wave-like extensions, co-extruded lines, dots, mats, and combinations thereof.

The polymeric strip may have a total thickness of from about 0.1 mm to about 5 mm and a total width of from about 10 mm to about 5,000 mm. Generally, the average concentration of HALS, organic UV absorbers, and inorganic UV absorbers in the outer polymeric layer(s) is from about 1.2 to about 10 times greater than the average concentration of HALS, organic UV absorbers, and inorganic UV absorbers throughout the entire strip (i.e., including the inner polymeric layer(s)).

Several embodiments of the polymeric strip used to make the CCS of the present disclosure are thus described. The polymeric strip may be a single-layer or multi-layer strip. In specific embodiments, the polymeric strip has at least one inner polymeric layer and least one outer polymeric layer. The outer polymeric layer is exposed to direct sunlight, whereas the inner polymeric layer is not. In other specific embodiments, the polymeric strip has two outer polymeric layers. Each layer may comprise UHH resistant polymers, additives, fillers, and/or barrier particles as described. Several specific embodiments are now further described.

One specific embodiment is a single layer UHH-resistant polymeric strip. The polymeric strip comprises a polymer, UV-absorbing particles, and HALS. The polymer may be a polyolefin or UHH-resistant polymer and combinations thereof. The polymeric strip may further comprise filler, pigments, dyes, and/or barrier particles to ensure a stable polymer under UHH conditions. The polymeric strip has a vivid color. Even with multiple additives, the color of the polymeric strip is determined primarily by the pigments or dyes used to create the color.

In another specific embodiment, the UHH-resistant polymeric strip is a multilayer strip and has at least one layer comprising up to 100% (w/w) MDPE or HDPE; up to 50% (w/w) linear low density polyethylene (LLDPE); up to 70% (w/w) filler; and 0.005 to 5% (w/w) additives selected from UV absorbers and HALS; and 0.005 to 50% (w/w) barrier particles.

In another specific embodiment, the UHH-resistant polymeric strip is a multilayer strip and has at least one layer comprising up to 100% (w/w) MDPE or HDPE; up to 100% (w/w) ethylene-acrylic or methacrylic acid ester copolymer or terpolymer; up to 70% (w/w) filler; and 0.005 to 50% (w/w) additives selected from UV absorbers and HALS; and 0.005 to 50% (w/w) barrier particles.

In another specific embodiment, the UHH-resistant polymeric strip is a multilayer strip and has at least one layer comprising a polymer, filler, and either a UV absorber or HALS. The layer may further comprise 0.005 to 50% (w/w)

barrier particles. The layer provides at least 10% lower extraction, evaporation and/or hydrolysis rate of the UV absorber relative to a layer of HDPE comprising the same additive and having the same dimensions.

A method is providing for making the polymeric layer(s) and/or strip(s). The method comprises a step of melt kneading at least one polymer with at least one additive in an extruder. The extruder may be a multi-screw extruder, especially a twin-screw extruder. In further embodiments, the extruder is a co-rotating twin screw extruder, especially a co-rotating twin screw extruder characterized by an L/D ratio of about 20 to 50. The extruder may be equipped with at least one side feeder, at least one atmospheric vent (for steam and air removal), and optionally a vacuum vent for degassing from volatile monomers and gaseous compounds. The mixture is then pumped downstream to form a film, strip, sheet, pellet, granule, powder or extruded article.

A master batch comprising a plurality of additives can be made, wherein a master batch refers to a concentrated dispersion and/or solution of all or part of the additives in a polymeric vehicle. The master batch of additives is fed from a hopper to the extruder and melt kneaded together with the other ingredients of the composition. The melt is then pumped downstream in the extruder into a dedicated mixing zone. Filler can then be fed into the mixing zone from a top or side feeder. Entrapped air and adsorbed humidity are removed by atmospheric venting. The mixture is further melt kneaded until most agglomerates are de-agglomerated and the filler is dispersed evenly in the mixture. Entrapped volatiles and/or byproducts may be removed by optional vacuum venting. The result is then pumped through a die to form pellets or a strip or directly shaped into the final polymeric strip. Alternatively, the pellets can be re-melted in a second extruder or molding machine and then shaped.

In another step, friction-enhancing integral structures are formed in the polymeric layer(s) and/or strip(s). The structures can be formed by embossing, punching, or extruding. In particular, embossing is done by calendar embossing.

Prior art polymers were made in a reactor. A reactor enables combination of few monomers in one backbone. However, making polymer in a reactor is different from making polymer in an extruder. A reactor enables manufacturing of UV-resistant polymers such as ethylene-acrylic acid ester copolymers and terpolymers; ethylene-methacrylic acid ester copolymers and terpolymers; acrylic acid ester copolymers and terpolymers. However, a reactor does not enable manufacturing of a finely dispersed blend of strong, heat-resistant polymers and UHH-resistant polymers. A reactor does not enable the dispersion of nanoparticles or fillers. In particular, it is difficult to evenly disperse filler in a reactor. However, it is easy to evenly disperse filler, nanoparticles, and more than one different polymer in an extruder. Extruder technology enables almost endless combinations. A co-rotating multi screw extruder, and especially a co-rotating twin screw extruder, enables the very fine dispersion of fine particles and of different polymers. Without this intensive mixing, short and long-term properties of the resulting polymer are inferior.

A three-dimensional cellular confinement system is formed from a plurality of UHH-resistant polymeric strips. Generally, each strip appears to have a wave-like pattern with peaks and valleys. The peaks of one strip are joined to the valleys of another strip so that a honeycomb-like pattern is formed. In other words, the strips are stacked parallel to each other and interconnected by a plurality of discrete physical joints, the joints being spaced apart from each other by non-joined portions. The joints may be formed by welding, bonding, sewing or any combination thereof. In specific embodiments, the joints are welded by ultrasonic means. In other embodiments, the joints are welded by pressure-less ultrasonic means. In embodiments, the distance between adjacent joints is from about 50 mm to about 1,200 mm.

The polymeric strips of the present disclosure have several desirable properties. By incorporating filler, they have improved heat conductivity to avoid temperature buildup is avoided as well as improved weld quality. The filler also lowers the CTE, so improved dimensional stability is obtained. By incorporating barrier particles, the leaching and/or evaporation of additives and the ingress of humidity, protons, or hydroxyl ions into the polymeric strip are reduced. By using UV absorbing particles, improved retention of UV resistance for period as long as 100 years is obtained.

The CCSs of the present disclosure have improved welding strength and durability. The strength of the welds is at least 10% greater compared to a polymeric strip consisting of virgin HDPE and an equivalent loading of additives. When welded strips are subjected to long term loading, their failure rate is at least 10% lower compared to welded strips consisting of virgin HDPE and an equivalent loading of additives. In addition, the welding cycle is at least 10% faster compared to a polymeric strip consisting of virgin HDPE and an equivalent loading of additives. This improved weldability is mostly significant when ultrasonic welding is used because polyethylene is relatively difficult to weld by ultrasonic welding due to its low density, crystallinity, and low coefficient of friction.

It is important to protect welds from deterioration. They are relatively weak points in the CCS and as one weld fails, its load is transferred to other welds, increasing their load and increasing the probability that it will fail as well. Providing welds with increased weld strength prevents this from happening.

The CCSs of the present disclosure also have a lower rate of extraction, evaporation, or hydrolysis. They have a rate of extraction for HALS and/or organic UV absorbers at least 10% lower compared to an HDPE strip of the same thickness and having the same average concentration of HALS and UV absorbers throughout the HDPE strip (as compared to the layers of the CCS of the present disclosure) when extraction is performed at ambient temperature in water for a period of from about 6 to 24 months. The residual content of the polymer can be determined by GC, HPLC or similar methods.

The CCSs also have at least 10% less degradation, as measured by the delta E color change and loss of elasticity (measured by elongation to break) compared to an HDPE strip of the same thickness and having the same average concentration of HALS and/or organic UV absorbers throughout the HDPE strip.

The present disclosure will further be illustrated in the following non-limiting working examples, it being understood that these examples are intended to be illustrative only and that the disclosure is not intended to be limited to the materials, conditions, process parameters and the like recited herein. All proportions are by weight unless otherwise indicated.

EXAMPLES

Example 1

Five UHH-resistant mixtures, INV1-INV5, and a reference mixture were made. Their composition is shown in TABLE 1. In addition, each mixture comprised 0.5% $TiO_2$ pigment (Kronos™ 2222 manufactured by Kronos) and 0.2% PV Fast Brown HFR™ brown pigment (manufactured by Clariant). The polymers, additives and pigments were fed to a main hopper of a co-rotating twin screw extruder running at 100-400 RPM at barrel temperature of 180 to 240 Celsius. The polymers were melted and the additives were dispersed by at least one kneading zone. Filler was provided from a side feeder. Steam and gases were removed by an atmospheric vent and the product was pelletized by a strand pelletizer.

TABLE 1

Composition of Polymers

| Ingredient | Reference1 | INV1 | INV2 | INV3 | INV4 | INV5 |
|---|---|---|---|---|---|---|
| HDPE (Kg) | 100 | 100 | 100 | 50 | 50 | 50 |
| LLDPE (Kg) | 0 | 0 | 0 | 0 | 50 | 50 |
| Ethylene-Acrylate (Kg) | 0 | 0 | 0 | 50 | 0 | 0 |
| Talc (Kg) | 0 | 20 | 20 | 20 | 20 | 20 |
| Organic UV absorber (Kg) | 0.15 | 0.5 | 0.5 | 0.5 | 0.5 | 0.5 |
| Inorganic UV absorber (Kg) | 0 | 0 | 1 | 1 | 1 | 1 |
| HALS (Kg) | 0.15 | 0.5 | 0.5 | 0.5 | 0.5 | 0.5 |
| Nano-clay (Kg) | 0 | 0 | 0 | 0 | 0 | 1 |

HDPE resin—HDPE M 5010 manufactured by Dow.
LLDPE resin—LL 3201 manufactured by Exxon Mobil.
Ethylene-Acrylate resin—Lotryl ™ 29MA03 manufactured by Arkema.
Talc—Iotalk ™ superfine manufactured by Yokal.
Organic UV absorber—Tinuvin ™ 234 manufactured by Ciba.
Inorganic UV absorber—SACHTLEBEN ™ Hombitec RM 130F TN, by Sachtleben.
HALS—Chimassorb ™ 944 manufactured by Ciba.
Nano-clay—Nanomer ™ I31PS manufactured by Nanocor.

Next, five polymeric strips ST1-ST5 and one reference strip were made. All strips were manufactured in a sheet extrusion line comprising a main single screw extruder for the core layer and secondary single screw for two outer layers. The core layer thickness was 0.8 mm and the outer layers had a thickness of 0.20 mm each. The composition of the strips is described in TABLE 2. The names of the polymers in each layer are according to TABLE 1.

TABLE 2

Composition of Strips

| Strip Number | ReferenceA | ST1 | ST2 | ST3 | ST4 | ST5 |
|---|---|---|---|---|---|---|
| Outer layer 1 | Reference1 | INV1 | INV2 | INV3 | INV4 | INV5 |
| Core layer | Reference1 | HDPE | HDPE | HDPE | HDPE | HDPE |
| Outer layer 2 | Reference1 | INV1 | INV2 | INV3 | INV4 | INV5 |

HDPE resin—HDPE M 5010 manufactured by Dow. No UV absorber or HALS additives.

Evaluation

The strips were evaluated for UHH resistance by accelerated aging in a Heraeus Xenotest 1200 W WOM, Relative Humidity=60%, Black Panel=60° C., 102 minutes dry cycle, 18 minutes wet cycle. The color difference (delta E) and relative loss of elongation to break ((initial elongation minus final elongation), divided by initial elongation) were measured after 10,000 hours aging. The results are summarized in TABLE 3.

TABLE 3

Results of Aging Test

| Strip Number | RefA | ST1 | ST2 | ST3 | ST4 | ST5 |
|---|---|---|---|---|---|---|
| Delta E | 22 | 12 | 10 | 6 | 10 | 8 |
| Relative loss of elongation to break (%) | 60 | 20 | 17 | 12 | 12 | 12 |

Example 2

Five mixtures, INV6-INV10, and a reference mixture were made. Their composition is shown in TABLE 4. In addition, each mixture comprised 0.5% $TiO_2$ pigment (Kronos™ 2222 manufactured by Kronos) and 0.2% PV Fast Brown HFR™ brown pigment (manufactured by Clariant). The polymers, additives and pigments were fed to a main hopper of a co-rotating twin screw extruder running at 100-400 RPM at barrel temperature of 260 to 285 Celsius. The polymers were melted and the additives were dispersed by at least one kneading zone. Filler was provided from a side feeder. Steam and gases were removed by an atmospheric vent and the product was pelletized by a strand pelletizer.

TABLE 4

Composition of Polymers

| Ingredient | Reference2 | INV6 | INV7 | INV8 | INV9 | INV10 |
|---|---|---|---|---|---|---|
| MA Functionalized HDPE (kg) | 0 | 100 | 100 | 70 | 40 | 40 |
| Virgin HDPE (Kg) | 100 | 0 | 0 | 0 | 0 | 0 |
| LLDPE (Kg) | 0 | 0 | 0 | 0 | 30 | 0 |
| Ethylene- Acrylate (Kg) | 0 | 0 | 0 | 0 | 0 | 30 |
| Recycled PET (Kg) | 0 | 25 | 25 | 25 | 25 | 25 |
| Talc (Kg) | 0 | 20 | 0 | 20 | 20 | 20 |
| Organic UV absorber (Kg) | 0.15 | 0.35 | 0.15 | 0.15 | 0.15 | 0.15 |
| Inorganic UV absorber (Kg) | 0 | 0 | 1 | 1 | 1 | 1 |
| HALS (Kg) | 0.15 | 0.15 | 0.15 | 0.15 | 0.15 | 0.15 |
| Nano-clay (Kg) | 0 | 0 | 0 | 1 | 0 | 1 |

MA Functionalized HDPE resin—HDPE M 5010 manufactured by Dow, grafted by 0.25-0.40% maleic anhydride (MA) in a reactive extruder.
Virgin HDPE—HDPE M 5010 manufactured by Dow. Not functionalized with MA.
Ethylene-Acrylate resin—Lotryl ™ 29MA03 manufactured by Arkema.

TABLE 4-continued

| Composition of Polymers | | | | | | |
|---|---|---|---|---|---|---|
| Ingredient | Reference2 | INV6 | INV7 | INV8 | INV9 | INV10 |

Talc—Iotalk ™ superfine manufactured by Yokal.
Organic UV absorber—Tinuvin ™ 234 manufactured by Ciba.
Inorganic UV absorber—SACHTLEBEN ™ Hombitec RM 130F TN, by Sachtleben.
HALS—Chimassorb ™ 944 manufactured by Ciba.
Nano-clay—Nanomer ™ I31PS manufactured by Nanocor.

Next, five polymeric strips ST6-ST10 and one reference strip were made. All strips were manufactured in a sheet extrusion line comprising a main single screw extruder for the core layer and secondary single screw for two outer layers. The core layer thickness was 0.8 mm and the outer layers had a thickness of 0.20 mm each. The Core layer was made of HDPE M 5010 manufactured by Dow, and outer layers were made of the compositions according to TABLE 4. Their composition was similar to that shown in TABLE 2, where RefB had two outer layers of composition Reference2, ST6 had two outer layers of composition INV6, etc.

Evaluation

The strips were evaluated for UHH resistance in hot areas. The strips were heated in an oven at 110° C. for seven days and the relative loss of elongation to break was then measured. This simulated the loss of additives by evaporation.

Next, to determine UHH resistance, the strips were subjected to humidity and heat by aging in water at 85° C. for seven days to allow extraction and hydrolysis of the additives. The strips were then exposed to artificial sunlight in a Heraeus Xenotest 1200 W WOM, Relative Humidity=60%, Black Panel=60° C., 102 minutes dry cycle, 18 minutes wet cycle. The color difference (delta E) and relative loss of elongation to break were measured after 10,000 hours aging. The results are summarized in TABLE 5.

TABLE 5

| Results of Aging Test | | | | | | |
|---|---|---|---|---|---|---|
| Strip Number | RefB | ST6 | ST7 | ST8 | ST9 | ST10 |
| Relative loss of elongation to break after oven heating (%) | 44 | 21 | 25 | 15 | 16 | 12 |
| Delta E after humidity and heat aging | 28 | 12 | 11 | 10 | 16 | 9 |
| Relative loss of elongation to break after humidity and heat aging (%) | 58 | 24 | 29 | 32 | 23 | 23 |

Next, twenty strips of each composition, 100 mm in length, were welded by ultrasonic horn at 20 MHz to obtain 10 couples. Five couples of each composition were randomly selected and their tensile strength was measured 48 hours after welding (T=0). The five couples were then subjected to aging in an oven at 110° C. for 21 days and their tensile strength was then measured again (T=21d) The averages of the measurements are given in TABLE 6.

TABLE 6

| Weld Strength after Heat Aging | | | | | | |
|---|---|---|---|---|---|---|
| Strip Number | RefB | ST6 | ST7 | ST8 | ST9 | ST10 |
| Weld strength (N) T = 0 | 1380 | 1700 | 1550 | 1830 | 1750 | 1750 |
| Weld strength (N) T = 21 d@110° C. | 450 | 1230 | 1240 | 1650 | 1430 | 1510 |

While particular embodiments have been described, alternatives, modifications, variations, improvements, and substantial equivalents that are or may be presently unforeseen may arise to applicants or others skilled in the art. Accordingly, the appended claims as filed and as they may be amended are intended to embrace all such alternatives, modifications variations, improvements, and substantial equivalents.

The invention claimed is:

1. A durable cellular confinement system comprising a plurality of polymeric strips;

each polymeric strip comprising at least one outer polymeric layer and at least one inner polymeric layer, wherein at least one layer is more resistant against UV light, humidity or heat (UHH) than virgin high density polyethylene (HDPE);

wherein the at least one outer polymeric layer comprises (a) either (i) high density polyethylene (HDPE) or (ii) medium density polyethylene (MDPE); and (b) either (i) a UV absorber or (ii) hindered amine light stabilizer (HALS).

2. The cellular confinement system of claim 1, wherein each polymeric strip comprises first and second outer polymeric layers, wherein all inner polymeric layers lie between the first outer polymeric layer and the second polymeric layer.

3. The cellular confinement system of claim 1, wherein the at least one inner polymeric layer contains additives in an amount of less than 0.5 weight percent, based on the weight of the at least one inner polymeric layer.

4. The cellular confinement system of claim 1, wherein at least one outer layer of each polymeric strip further comprises an additive selected from the group consisting of antioxidants, pigments, dyes, carbon black, and barrier particles.

5. The cellular confinement system of claim 4, wherein the antioxidant is selected from the group consisting of hindered phenols, phosphates, phosphates, and aromatic amines.

6. The cellular confinement system of claim 4, wherein the pigment or dye does not ender the polymeric strip black or dark gray.

7. The cellular confinement system of claim 4, wherein the barrier particles are selected from the group consisting of clays, organo-modified clays, nanotubes, metallic flakes, ceramic flakes, metal coated ceramic flakes, and glass flakes.

8. The cellular confinement system of claim 1, wherein the UV absorber is an inorganic particle comprising a material selected from the group consisting of titanium salts, titanium oxides, zinc oxides, zinc halides, and zinc salts.

9. The cellular confinement system of claim 8, wherein the inorganic UV absorber particles are nanoparticles having an average diameter of from about 5 to about 100 nanometers.

10. The cellular confinement system of claim 1, wherein at least one layer further comprises a filler.

11. The cellular confinement system of claim 10, wherein the filler is in the form of whiskers or fibers and has an average particle size of less than 50 microns.

12. The cellular confinement system of claim 10, wherein the filler is selected from the group consisting of mineral fillers, metal oxides, metal carbonates, metal sulfates, metal phosphates, metal silicates, metal borates, metal hydroxides, silica, silicates, aluminates, alumosilicates, fibers, whiskers, industrial ash, concrete powder or cement, natural fibers, kenaf, hemp, flax, ramie, sisal, newprint fibers, paper mill sludge, sawdust, wood flour, carbon, aramid, and mixtures thereof.

13. The cellular confinement system of claim 10, wherein the filler is a mineral selected from the group consisting of calcium carbonate, barium sulfate, dolomite, alumina trihydrate, talc, bentonite, kaolin, wollastonite, clay, and mixtures thereof.

14. The cellular confinement system of claim 10, wherein the filler is surface treated with a sizing agent or coupling agent selected from the group consisting of fatty acids, esters, amides, and salts thereof, silicone containing polymer or oligomer, organometallic compounds, titanates, silanes, and zirconates.

15. The cellular confinement system of claim 10, wherein the filler has a high heat conductivity and is selected from the group consisting of metal carbonates, metal sulfates, metal oxides, metals, metal coated minerals and oxides, alumosilicates, and mineral fillers.

16. The cellular confinement system of claim 1, the UV absorber is a benzotriazole or a benzophenone.

17. The cellular confinement system of claim 1, wherein the UV absorber or the HALS are present in an amount of from about 0.01 to about 2.5 weight percent of the at least one outer layer, based on the weight of the at least one outer layer.

18. The cellular confinement system of claim 1, wherein the at least one inner polymeric layer further comprises a UV absorber and hindered amine light stabilizer in the amount of from 0 to about 0.25 weight percent, based on the weight of the at least one inner polymeric layer.

19. The cellular confinement system of claim 1, wherein at least one polymeric layer of each polymeric strip comprises a friction-enhancing structure selected from the group consisting of textured patterns, embossed patterns, holes, finger-like extensions, hair-like extensions, wave-like extensions, co-extruded lines, dots, mats, and combinations thereof.

20. The cellular confinement system of claim 1, wherein each polymeric strip has a total thickness of from about 0.1 mm to about 5 mm, a total width of from about 10 mm to about 500 mm, and a total length of from about 10 mm to about 5,000 mm.

21. The cellular confinement system of claim 1, wherein each polymeric strip comprises first and second outer polymeric layers, wherein one outer polymeric layer has a greater concentration of UV absorbers and HALS additives than the other outer polymeric layer.

22. The cellular confinement system of claim 1, wherein at least one layer of each polymeric strip comprises up to 100 weight percent MDPE or HDPE; up to 50 weight percent linear low density polyethylene (LLDPE); up to 70 weight percent mineral filler; from 0.005 to 5 weight percent additives selected from the group consisting of UV absorbers and HALS; and from 0.005 to 50 weight percent barrier particles.

23. The cellular confinement system of claim 1, wherein at least one layer of each polymeric strip comprises up to 100 weight percent MDPE or HDPE; up to 100 weight percent ethylene-acrylic acid ester copolymer or terpolymer; up to 70 weight percent mineral filler; from 0.005 to 5 weight percent additives selected from the group consisting of UV absorbers and HALS; and from 0.005 to 50 weight percent barrier particles.

24. A cellular confinement system that is resistant to ultraviolet light, heat, or humidity, comprising a plurality of polymeric strips;

each polymeric strip comprising at least one polymeric layer containing (a) a UV absorber; (b) either (i) high density polyethylene (HDPE) or (ii) medium density polyethylene (MDPE); and (c) a polymer selected from the group consisting of ethylene-acrylic acid ester copolymers and terpolymers; ethylene-methacrylic acid ester copolymers and terpolymers; acrylic acid ester copolymers and terpolymers; aliphatic polyesters; aliphatic polyamides; aliphatic polyurethanes; mixtures thereof; and mixtures thereof with at least one polyolefin;

wherein a first polymeric strip is stacked parallel to a second polymer strip and joined to the second polymeric strip by a plurality of discrete physical joints, the joints being spaced apart from each other by non-joined portions of the polymeric strips.

25. A durable cellular confinement system comprising a plurality of polymeric strips resistant to UV light, humidity or heat (UHH), each polymeric strip comprising at least one outer polymeric layer and at least one inner polymeric layer;

wherein the at least one outer polymeric layer comprises a polymer blend of (a) ethylene-acrylate polymer and either (i) high density polyethylene (HDPE) or (ii) medium density polyethylene (MDPE); and (b) either (i) a UV absorber or (ii) a hindered amine light stabilizer (HALS).

26. The cellular confinement system of claim 25, wherein the ethylene-acrylate polymer is selected from the group consisting of ethylene-acrylic acid ester copolymers and terpolymers; and ethylene-methacrylic acid ester copolymers and terpolymers.

* * * * *